US006877490B2

(12) United States Patent
Nishioka et al.

(10) Patent No.: US 6,877,490 B2
(45) Date of Patent: Apr. 12, 2005

(54) ENGINE CONTROL UNIT OPERABLE UNDER IGNITION SWITCH TURN-OFF

(75) Inventors: Hiroshi Nishioka, Kariya (JP); Kazutoshi Morisada, Handa (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/734,158

(22) Filed: Dec. 15, 2003

(65) Prior Publication Data

US 2004/0123845 A1 Jul. 1, 2004

(30) Foreign Application Priority Data

Jan. 24, 2003 (JP) ..... 2003-016585
Oct. 29, 2003 (JP) ..... 2003-369367

(51) Int. Cl.[7] ..... F02M 37/04
(52) U.S. Cl. ..... 123/520; 123/198 D
(58) Field of Search ..... 123/516, 518, 123/519, 520, 198 D, 179.16

(56) References Cited

U.S. PATENT DOCUMENTS 5,150,689 A * 9/1992 Yano et al. ..... 123/519
5,195,498 A * 3/1993 Siebler et al. ..... 123/698
5,331,560 A * 7/1994 Tamura ..... 701/115
5,462,034 A * 10/1995 Kadota ..... 123/520
5,479,905 A * 1/1996 Ito ..... 123/520
5,575,265 A 11/1996 Kurihara et al.
5,873,352 A * 2/1999 Kidokoro et al. ..... 123/520
6,192,742 B1 * 2/2001 Miwa et al. ..... 73/40
6,789,523 B2 * 9/2004 Oki et al. ..... 123/198 D

FOREIGN PATENT DOCUMENTS

JP 13-173523 6/2001
JP 2001-295678 10/2001

* cited by examiner

*Primary Examiner*—Thomas Moulis
(74) *Attorney, Agent, or Firm*—Nixon & Vanderhye P.C.

(57) ABSTRACT

On the condition that a predetermined time has passed after an engine control unit stops its normal engine control operation when the ignition switch of a vehicle is turned off, the control unit can be supplied automatically with operating power to start up and execute an evaporation gas purging diagnosis process for detecting the leakage in the evaporation gas purge system of the vehicle. If the control unit determines that it has started up on the foregoing condition, it inhibits the operation of the electric loads of the vehicle that are needless for the evaporation gas purging diagnosis process. This reliably prevents wasteful power consumption, thereby preventing the battery of the vehicle from running down.

16 Claims, 7 Drawing Sheets

ENGINE CONTROL UNIT OPERABLE UNDER IGNITION SWITCH TURN-OFF

CROSS REFERENCE TO RELATED APPLICATION

This application is based on and incorporates herein by reference Japanese Patent Applications No. 2003-16585 filed on Jan. 24, 2003 and 2003-369367 filed on Oct. 29, 2003.

FIELD OF THE INVENTION

The present invention relates to an engine control unit for controlling an engine of a vehicle. In particular, the invention relates to an engine control unit for executing a specific control process with operating power supplied even on a starting condition other than the condition that the ignition switch of the vehicle is turned on while the engine is not operating.

BACKGROUND OF THE INVENTION

In general, an engine control unit for controlling the engine of a vehicle operates with operating power supplied from the battery of the vehicle when the ignition switch of the vehicle is turned on. In recent years, an engine control unit is required to execute specific control processes at certain times even while the engine is not operating with the ignition switch turned off.

For instance, the specific control processes include an evaporation gas purge diagnosis process for detecting the leakage in an evaporation gas purge system.

The evaporation gas purge system is for purging evaporated fuel gas, which prevents the gaseous fuel evaporated in the fuel tank of a vehicle from being released into the atmosphere. The evaporation gas purge system makes the adsorbent in its canister temporarily adsorb the gaseous fuel, purges the adsorbed gaseous fuel into the intake pipe of the engine of the vehicle together with the fresh air sucked through the air hole of the canister in accordance with the operating condition of the engine, and burns the purged gaseous fuel (for instance, patent documents 1 and 2).

Patent Document 1: U.S. Pat. No. 5,575,265 (JP 1996-35452A)

Patent Document 2: JP P2001-173523A

If there are holes or cracks in the fuel tank, the evaporation passage between the tank and the canister, etc. of the evaporation gas purge system, the evaporated gaseous fuel is released into the atmosphere, without being adsorbed by the canister.

In order to prevent the air pollution caused by such failures of the evaporation gas purge system, the engine control unit executes an evaporation gas purging diagnosis process to detect the leakage in this system. The evaporation gas purging diagnosis process may involve checking the air tightness of the evaporation gas purge system by measuring the pressure fluctuation in the system by means of a pressure sensor, with the system blocked by a solenoid valve (for example, patent document 1).

In the evaporation gas purging diagnosis process, however, it is difficult to obtain accurate test results because the fuel in the fuel tank easily evaporates after the engine operates under a high load for a long time. Therefore, it is likely that the engine control unit executes the evaporation gas purging diagnosis process as a specific control process when a predetermined time has passed after the engine stops.

In order to meet the above requirement, the engine control unit may be kept operating with the operating power supplied even when the engine is not operating. In this case, however, the battery runs down because of high power consumption.

Therefore, in order to meet the above requirement with low power consumption, it is conceivable that the engine control unit is activated with the operating power supplied if the ignition switch is turned on, or if other power supply starting condition for executing the specific control process is met even when the ignition switch is maintained in the turned-off condition.

However, when the engine control unit is activated on the starting condition for executing the specific control process, this unit may drive electric loads unrelated to the specific control process. In this case also, the battery may run down because the engine is not operating and the battery is not cahrged.

SUMMARY OF THE INVENTION

The object of the present invention is to provide an engine control unit for executing a specific control process, without making the battery of a vehicle run down, by starting up on a starting condition other than the condition that the ignition switch of the vehicle is turned on even while the engine is not operating.

An engine control unit for achieving the foregoing object starts up with operating power supplied on the condition that the ignition switch of a vehicle is turned on, or on other starting conditions. The control unit controls the engine of the vehicle if the control unit starts up on the condition that the ignition switch is turned on. The control unit executes a specific control process if the control unit starts up on specific power supply condition.

In particular, if the control unit starts up on specific power supply condition, it inhibits the operation of other electric loads of the vehicle other than that required for the control process. Accordingly, when the control unit starts up on the starting condition other than the condition that the ignition switch is turned on, the electric load needless for the control process is prevented reliably from being driven. This prevents wasteful power consumption, thereby keeping the battery of the vehicle from running down.

Alternatively, if the control unit starts up on the specific power supply condition, an inhibit means inhibits the operation of other circuits of the vehicle other than that required for the control process. If the control unit starts up on the starting condition other than the condition that the ignition switch is turned on, the electric load needless for the control process is prevented from being driven. This keeps the battery from running down.

The engine control unit may include a microcomputer, which starts up with operating power supplied on the condition that the ignition switch is turned on, or on specific power supply conditions. The microcomputer controls the engine if the microcomputer starts up on the condition that the ignition switch is turned on. The microcomputer executes the specific control process if the microcomputer starts up on specific power supply condition. In particular, the microcomputer determines whether it has started upon specific power supply condition or not. If the microcomputer determines that it has started up on specific power supply condition, it inhibits the operation of the electric load other than that required for the control process, and executes the control process. If the microcomputer starts up on the starting condition other than the condition that the ignition switch is turned on, the electric load needless for the control process is prevented reliably from being driven. This keeps the battery from running down.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE PREFERRED EMBODIMENTS (First Embodiment)

Figure 1:
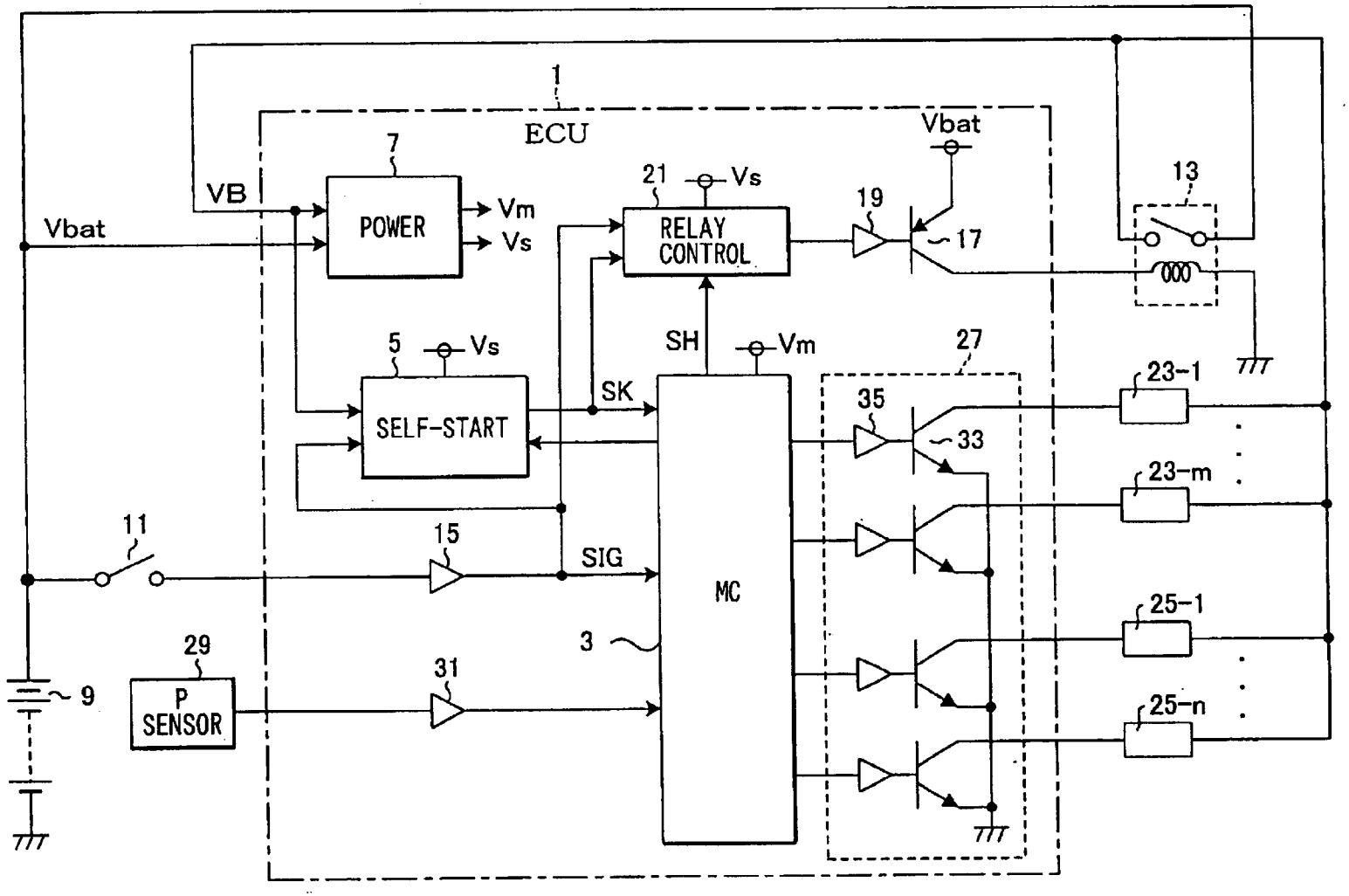
FIG. 1 is a block diagram showing an engine control unit according to a first embodiment of the present invention.

Referring first to FIG. 1, an engine control unit 1 includes a microcomputer (MC) 3, a self-starting integrated circuit (IC) 5 and a power supply circuit 7. The microcomputer 3 executes various processes for controlling an engine of a vehicle. The self-starting IC 5 starts up the engine control unit 1 while the engine is not operating. The power supply circuit 7 outputs a main supply voltage Vm for activating the microcomputer 3 and an auxiliary supply voltage Vs for activating the self-starting IC 5. The supply voltages Vm and Vs are 5 volts.

The power supply circuit 7 is supplied continuously with a battery voltage Vbat directly from the positive terminal of the battery 9 of the vehicle. The battery voltage Vbat is normally 12 volts. The power supply circuit 7 continuously produces the auxiliary supply voltage Vs from the battery voltage Vbat.

If the ignition switch 11 of the vehicle is turned on, or if the level of the power supply starting signal SK output from the self-starting IC 5 or the power supply holding signal SH output from the microcomputer 3 is high, the power supply circuit 7 is supplied with the battery voltage VB. This voltage VB is the battery voltage Vbat supplied from the positive terminal of the battery 9 through a main relay 13, which is provided outside the engine control unit 1. The power supply circuit 7 generates the main supply voltage Vm from the battery voltage VB.

The engine control unit 1 also includes an input circuit 15. If the battery voltage Vbat is input through the ignition switch 11 into the input circuit 15, this circuit generates an ignition switch signal SIG of 5 volts, which are a high level, from the battery voltage Vbat. If the ignition switch 11 is turned off, the battery voltage Vbat is not input into the input circuit 15, which then lowers the ignition switch signal SIG to 0 volt, which is a low level. Thus, the ignition switch signal SIG indicates whether the ignition switch 11 is turned on or off.

The engine control unit 1 further includes a PNP transistor 17 and a main relay control circuit 21. The collector of the PNP transistor 17 is connected to one terminal of the coil of the main relay 13. The other terminal of this coil is grounded. The emitter of the PNP transistor 17 is connected to the positive terminal of the battery 9. If the PNP transistor 17 is turned on, an electric current flows through the coil of the main relay 13. If the level of at least one of the ignition switch signal SIG from the input circuit 15, the power supply starting signal SK from the self-starting IC 5 and the power supply holding signal SH from the microcomputer 3 is high, the main relay control circuit 21 causes a buffer circuit 19 to turn on the PNP transistor 17, energizing the coil of the main relay 13 to short-circuit the contacts of this relay. As is the case with the self-starting IC 5, the relay control circuit 21 operates with the auxiliary supply voltage Vs supplied from the power supply circuit 7.

Accordingly, if the level of any of the ignition switch signal SIG, the power supply starting signal SK from the self-starting IC 5 and the power supply holding signal SH from the microcomputer 3 is high, the main relay 13 is turned on, supplying the battery voltage VB to the power supply circuit 7, which then outputs the main supply voltage Vm.

The power supply circuit 7 performs a power-on reset function. This function is to output, when the power supply circuit 7 starts outputting the main supply voltage Vm, a reset signal to the microcomputer 3 for a very short time in which this voltage Vm is considered to stabilize. Accordingly, if the power supply circuit 7 starts outputting the main supply voltage Vm, the microcomputer 3 starts up from its initial state.

The self-starting IC 5 performs the following functions (1)–(3):

(1) If the ignition switch 11 is turned off so that the level of the ignition switch signal SIG from the input circuit 15 is low, and if the battery voltage VB from the main relay 13 is 0 volt so that the voltage VB is not supplied from this relay to the engine control unit 1, the self-starting IC 5 starts a time (counting) operation. If a time preset by the microcomputer 3 has passed, the self-starting IC 5 holds high the output level of the power supply starting signal SK for the main relay control circuit 21.

(2) If the level of the ignition switch signal SIG from the input circuit 15 becomes high, the self-starting IC 5 resets the output level of the power supply starting signal SK to a low level, and also resets the count for measuring the lapse of the preset time.

(3) If the self-starting IC 5 receives a "clear" instruction from the microcomputer 3, it resets the output level of the power supply starting signal SK to the low level.

The microcomputer 3 starts up with the main supply voltage Vm supplied from the power supply circuit 7 and then makes high the level of the power supply holding signal SH for the main relay control circuit 21. The high-level signal SH keeps the battery voltage VB supplied from the main relay 13 to the engine control unit 1 so that the power supply circuit 7 outputs the main supply voltage Vm. This enables the microcomputer 3 and the engine control unit 1 to operate. In this embodiment, the start-up of the microcomputer 3 is the start-up of the engine control unit 1. The battery voltage VB supplied through the main relay 13 corresponds to the power supply for the operation of the engine control unit 1.

If the microcomputer 3 is activated with the ignition switch 11 turned on so that the ignition switch signal SIG changes to its high level, an operation stop condition is met when all processes for stopping the engine end after the ignition switch 11 is turned off. On this condition, the microcomputer 3 stops its operation by making the level of the power supply holding signal SH low to stop the power supply circuit 7 from supplying the main supply voltage Vm.

If the microcomputer 3 is activated with the level of the power supply starting signal SK becoming high while the ignition switch 11 is maintained turned off, a specific control process (an evaporation gas purging diagnosis process) is executed. When the control process ends, an operation stop condition is met. On this condition, the microcomputer 3 stops its operation by outputting a "clear" instruction to the self-starting IC 5 to make the level of the power supply starting signal SK low, and by making the level of the power supply holding signal SH low to stop the power supply circuit 7 from supplying the main supply voltage Vm.

The engine control unit 1 also includes a drive circuit 27 for driving a number of electric loads 23-1 to 23-m and 25-1 to 25-n related to engine control. The engine control unit 1 further includes an input circuit 31 for receiving the signals from various sensors such as a pressure sensor 29 and various switches such as a starter switch.

The battery voltage VB can be applied to one terminal of each of the electric loads 23-1 to 23-m and 25-1 to 25-n. The drive circuit 27 may include drive transistors 33 and buffer circuits 35. The collector of each drive transistor 33 is connected to the other terminal of one of the electric loads 23-1 to 23-m and 25-1 to 25-n. The base of each drive transistor 33 is connected to the output terminal of one of the buffer circuits 35. If any of the drive transistors 33 are turned on, the associated terminals of the associated electric loads are short-circuited to the ground potential so that an electric current can flow through these electric loads. Each buffer circuit 35 turns on or off the associated drive transistor 33 in accordance with a control signal from the microcomputer 3.

The electric loads 23-1 to 23-m are necessary for an evaporation gas purging diagnosis process. The electric loads 25-1 to 25-n are not related to the evaporation gas purging diagnosis process and include injectors and igniters for engine control.

The evaporation gas purging diagnosis process and an evaporation gas purge system for the vehicle will be described briefly below.

Figure 2:
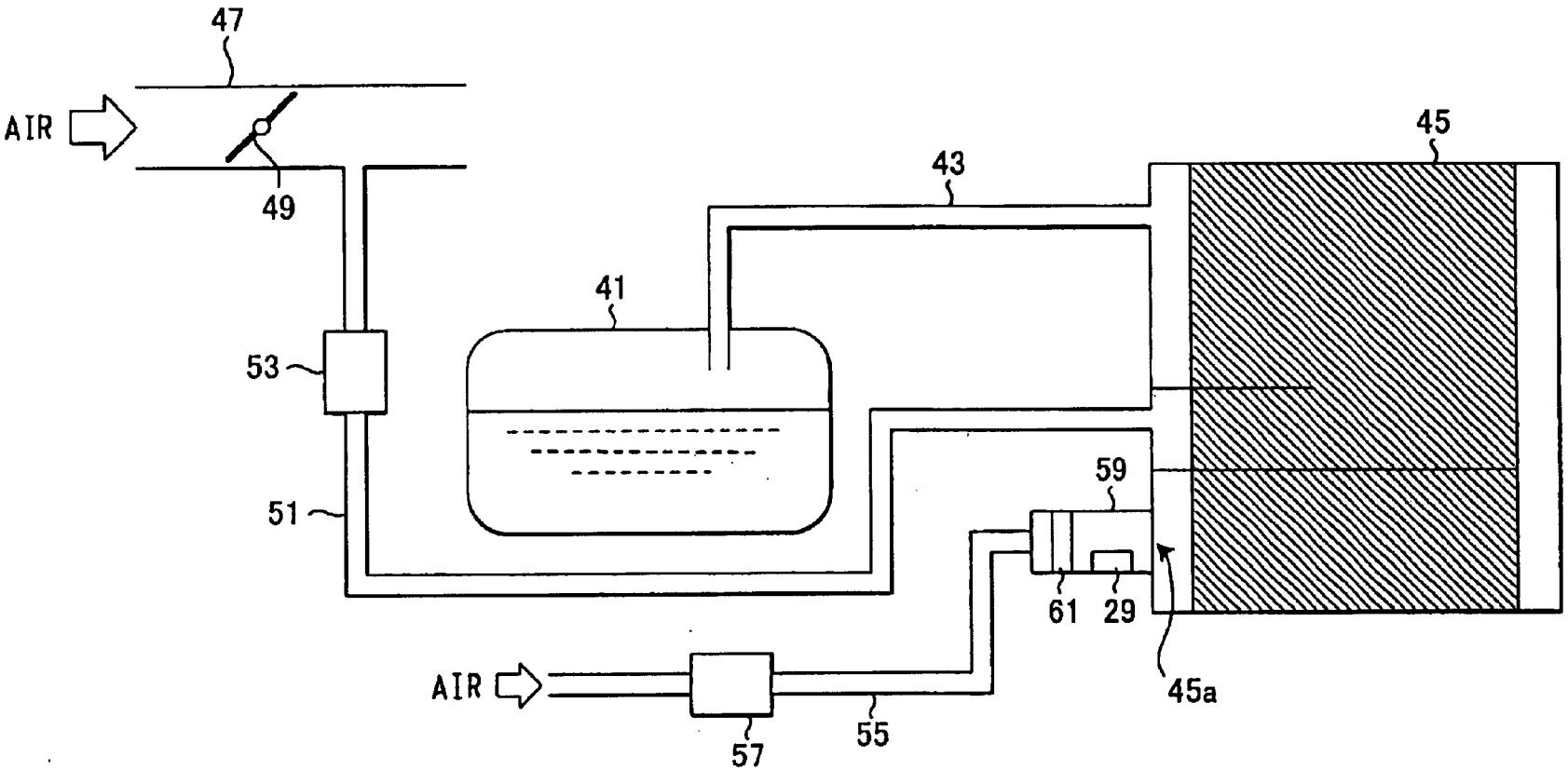
FIG. 2 is a schematic diagram showing an evaporation gas purge system.

As shown in FIG. 2, the evaporation gas purge system includes a canister 45, a purge passage 51, an air intake passage 55 and an electric pump 59. The canister 45 is connected through an evaporation passage 43 with the fuel tank 41 of the vehicle. The gaseous fuel evaporated in the canister 45 can be purged through a purge passage 51 to the downstream side of the throttle valve 49 in an intake pipe 47 of the engine. The purge passage 51 is fitted with a solenoid purge valve 53 for closing and opening it. The canister 45 has an air hole 45*a*. Fresh air can be taken in through the intake passage 55 into the air hole 45*a*. The intake passage 55 is fitted with an air filter 57. The electric pump 59 is provided between the air hole 45*a* and the intake passage 55 to exert pressure in the canister 45. The electric pump 59 is fitted with a solenoid control valve 61 and a pressure sensor 29 as integral parts of it. The control valve 61 closes and opens the air hole 45*a*. The pressure sensor 29 senses the pressure (P) in the canister 45.

Normally, the purge valve 53 is closed, and the control valve 61 is opened to open the air hole 45*a* of the canister 45 so that the canister can adsorb the gaseous fuel evaporated in the fuel tank 41. If the purge valve 53 is opened according to the operating condition of the engine, the negative pressure in the intake pipe 47 desorbs the adsorbed fuel from the canister 45 and discharges it into the intake pipe 47 together with the air flowing through the intake passage 55 into the air hole 45*a*. The gaseous fuel sent to the intake pipe 47 can then be burned in the engine.

The evaporation gas purging diagnosis process for detecting the leakage in the evaporation gas purge system can be executed through the following procedure.

The procedure includes steps of closing the purge valve 53, opening the control valve 61, activating the electric pump 59 to exert negative pressures on the canister 45 and the fuel tank 41, and thereafter closing the control valve 61. These steps are followed by the steps of measuring the pressures in the canister 45 and the fuel tank 41 at regular or specific time intervals with the pressure sensor 29, and determining from variations in the measured pressures whether there are leaks in the evaporation gas purge system (specifically whether there are holes and/or pores in the fuel tank 41, evaporation passage 43, canister 45 and/or purge passage 51). If there are leaks in the system, the pressures sensed by the pressure sensor 29 quickly fall from their normal values toward the atmospheric pressure. The detection of this phenomenon makes it possible to sense the abnormality (occurrence of the leaks).

The purge valve 53, electric pump 59 and control valve 61 correspond to the electric loads 23-1 to 23-m shown in FIG. 1. The microcomputer 3 controls the evaporation gas purge system and executes the evaporation gas purging diagnosis process.

Figure 3:
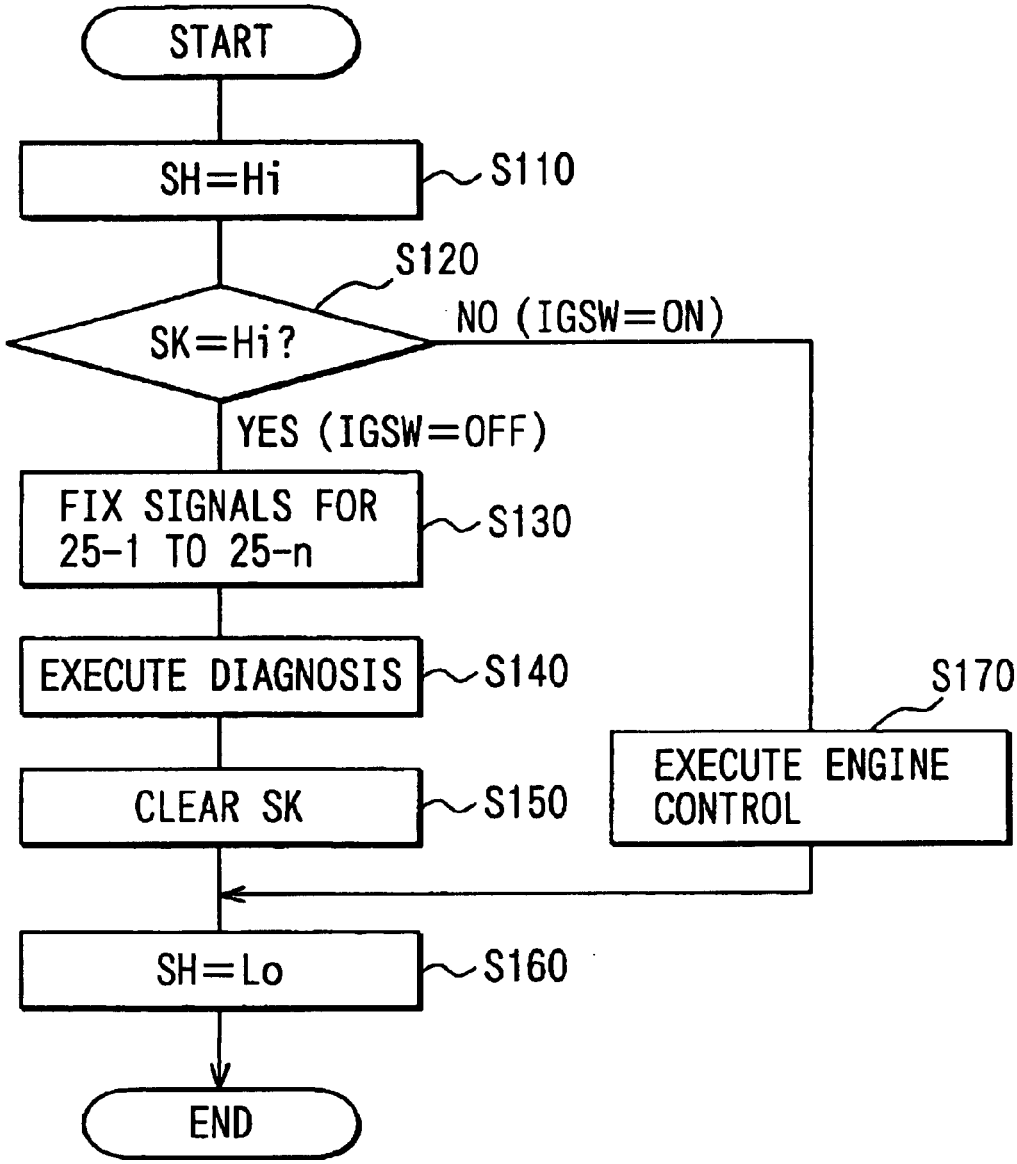
FIG. 3 is a flowchart showing the processing executed by a microcomputer of the engine control unit according to the first embodiment.

FIG. 3 is a flowchart of the whole processing executed by the microcomputer 3. When the microcomputer 3 starts up with the main supply voltage Vm received from the power supply circuit 7, the processing proceeds to the first step S110. Step S110 is to make the level of the power supply holding signal SH high to turn on the main relay 13 so that the power supply circuit 7 keeps producing the supply voltage Vm.

The next step S120 is to read the logic level of the power supply starting signal SK output from the self-starting IC 5 to the main relay control circuit 21 and determine whether the level of this signal SK is high (Hi) or low (Lo). This step determines whether the microcomputer 3 has been activated with the ignition switch 11 turned on or by the self-starting IC 5.

If it is determined at step S120 that the level of the power supply starting signal SK is high, it is determined that the self-starting IC 5 has activated the microcomputer 3 (namely, the microcomputer 3 has started up on the condition that the level of the signal SK from the IC 5 is high, the condition being other than the condition that the ignition switch (IGSW) 11 is turned on. Then, the processing proceeds to step S130.

Step S130 is to fix the control signals for the electric loads 25-1 to 25-n at the output level on the non-operating side. These loads are other than the electric loads 23-1 to 23-m necessary for the evaporation gas purging diagnosis process and have no connection with this process. The signal fixation inhibits the operation of the electric loads 25-1 to 25-n. The next step S140 is to execute the evaporation gas purging diagnosis process through the foregoing procedure.

The result of the evaporation gas purging diagnosis process is stored in a reloadable non-volatile memory (not shown), which may be provided in or outside the microcomputer 3. The stored result may be read out to a diagnostic unit (not shown), which is connected via a communication line to the engine control unit 1. If the stored result is abnormal, it may be indicated by an exhaust of the vehicle.

The evaporation gas purging diagnosis process at step S140 is followed by step S150 of outputting a "clear" instruction to the self-starting IC 5 so as to make the level of the power supply starting signal SK low.

The next step S160 is to restore the power supply holding signal SH to the low level. This switches off the main relay 13 to stop the power supply circuit 7 from outputting the main supply voltage Vm. Consequently, the microcomputer 3 stops operating, so that the engine control unit 1 stops operating.

If it is determined at step S120 that the level of the power supply starting signal SK is not high (is low), it is determined that the microcomputer 3 has been activated with the ignition switch 11 turned on. Then, the processing proceeds to step S170.

Step S170 is to execute engine control processes (a fuel injection control process, an ignition control process, etc) for controlling the engine. In the engine control processes, the ignition switch signal SIG from the input circuit 15 is the basis for detecting whether the ignition switch 11 is turned off. If it is detected that the ignition switch 11 is turned off, the processes for stopping the engine end, so that the operation stop condition is met. Then, the processing proceeds to step S160 of restoring the power supply holding signal SH to the low level. This switches off the main relay 13 to stop the microcomputer 3 and the engine control unit 1 from operating.

If the ignition switch 11 is turned on, the level of the ignition switch signal SIG becomes high, turning on the main relay 13, so that the power supply circuit 7 outputs the main supply voltage Vm, which then activates the microcomputer 3. The activated microcomputer 3 executes the processes (S170) for controlling the engine. In this case, the level of the power supply starting signal SK is low.

Thereafter, if the ignition switch 11 is turned off, the microcomputer 3 makes the level of the power supply holding signal SH low by means of the process at S160. Consequently, the main relay 13 is turned off so that the power supply circuit 7 outputs no main supply voltage Vm. This stops the microcomputer 3 and the engine control unit 1 from operating.

When the ignition switch 11 is thus turned off, so that the microcomputer 3 and the engine control unit 1 stop operating, the foregoing function 1 makes the self-starting IC 5 start a timing operation. When a predetermined time has passed thereafter, the level of the power supply starting signal SK from the self-starting IC 5 to the main relay control circuit 21 is high. Consequently, the main relay 13 is turned on so that the power supply circuit 7 outputs the main supply voltage Vm.

The main supply voltage Vm activates the microcomputer 3, which then makes the level of the power supply holding signal SH high at step S110 of FIG. 3. Consequently, the main relay 13 is turned on so as to keep the main supply voltage Vm supplied.

In this case, because the level of the power supply starting signal SK from the self-starting IC 5 is high, the microcomputer 3 makes a positive determination (YES) at step S120 of FIG. 3. Then, the processing proceeds to step S130, where the electric loads 25-1 to 25-n, which have no connection with the evaporation gas purging diagnosis process, are inhibited from operating. Thereafter, the evaporation gas purging diagnosis process (S140) is executed.

After the evaporation gas purging diagnosis process at S140 of FIG. 3, the microcomputer 3 resets the power supply starting signal SK from the self-starting IC 5 to the low level (S150) and makes the level of the power supply holding signal SH low (S160). Consequently, the main relay 13 is turned off so that the power supply circuit 7 outputs no main supply voltage Vm. This stops the microcomputer 3 and the engine control unit 1 from operating.

As stated above, if the ignition switch 11 is turned on, or on the condition that a predetermined time has passed after the engine control unit 1 stops its operation when the ignition switch 11 is turned off, the engine control unit 1 starts up with the battery voltage VB supplied as the operating power supply from the main relay 13. If the engine control unit 1 starts up with the ignition switch 11 turned on, the engine control unit 1 controls the engine. If the engine control unit 1 starts upon the starting condition, the engine control unit 1 executes the evaporation gas purging diagnosis process as the specific control process.

In particular, if the engine control unit 1 starts up on the foregoing condition while the ignition switch 11 is off (while the engine is not operating), this control unit 1 inhibits the operation of the electric loads 25-1 to 25-n (S130) other than the loads 23-1 to 23-m necessary for the evaporation gas purging diagnosis process.

Consequently, while the engine is not in operation, without the battery 9 charged, the electric loads 25-1 to 25-n (S130), which are for the engine control and needless for the evaporation gas purging diagnosis process, are prevented reliably from being driven with electric power wasted. This prevents the battery 9 from bein drawn.

Step S130 in FIG. 3 thus performs inhibition, and the self-starting IC 5 thus operate as a timer. At step S120 in FIG. 3, it might alternatively be determined from the logic level of the ignition switch signal SIG whether the microcomputer 3 has been activated with the ignition switch 11 turned on or by the self-starting IC 5. In this case, the processing of FIG. 3 would proceeds to step S130 if the level of the ignition switch signal SIG is low, and the processing would proceeds to step S170 if the signal level is high.

(Second Embodiment)

Figure 4:
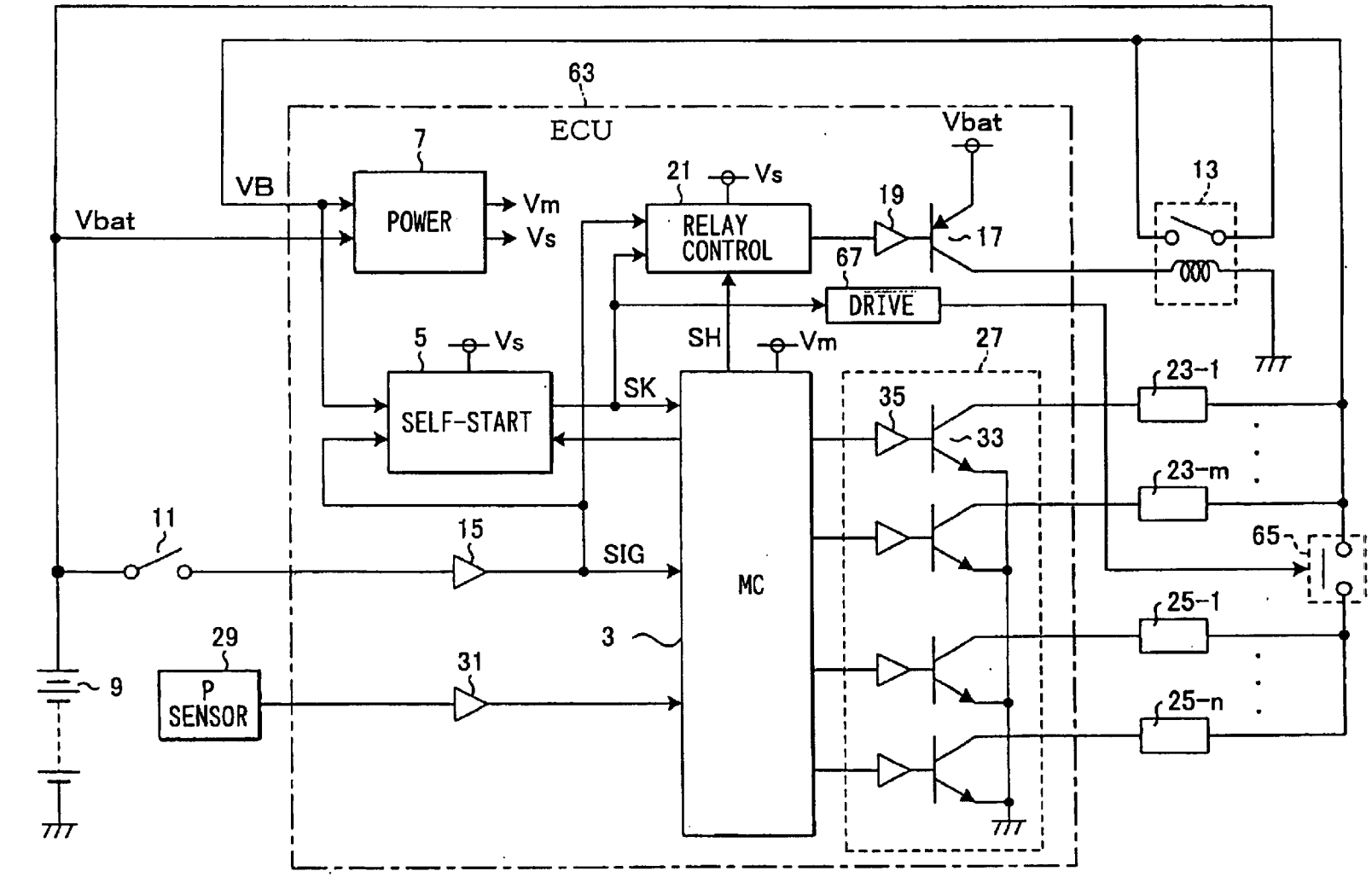
FIG. 4 is a block diagram showing an engine control unit according to a second embodiment of the present invention.

FIG. 4 shows an engine control unit 63 according to a second embodiment. The same components in FIGS. 1 and 4 are assigned the same reference numerals and will not be described below in detail.

As shown in FIG. 4, the engine control unit 63 differs from the engine control unit 1 according to the first embodiment as follows.

The battery voltage VB can be applied through a switching device 65, which may be a relay, to the terminals of the electric loads 25-1 to 25-n that are not connected to the drive circuit 27. These loads are needless for the evaporation gas purging diagnosis process.

The engine control unit 63 also includes a drive circuit 67. When the level of the power supply starting signal SK from the self-starting IC 5 is high, the drive circuit 67 turns off the switching device 65 to forcedly cut off the power supply (the supply of battery voltage VB) to the electric loads 25-1 to 25-n.

Thus, if the microcomputer 3 is activated by the operation of the self-starting IC 5, the power supply to the electric loads 25-1 to 25-n, which are needless for the evaporation gas purging diagnosis process, is cut off. This more reliably prevents wasteful power consumption.

The switching device 65 and the drive circuit 67 thus performs inhibition. In the second embodiment, the microcomputer 3 may not execute the process at step S130 in FIG.

3. However, the execution of this process is more advantageous or favorable because there is no possibility that needless control signals are output, so that the power consumption can be reduced.

(Third Embodiment)

Figure 5:
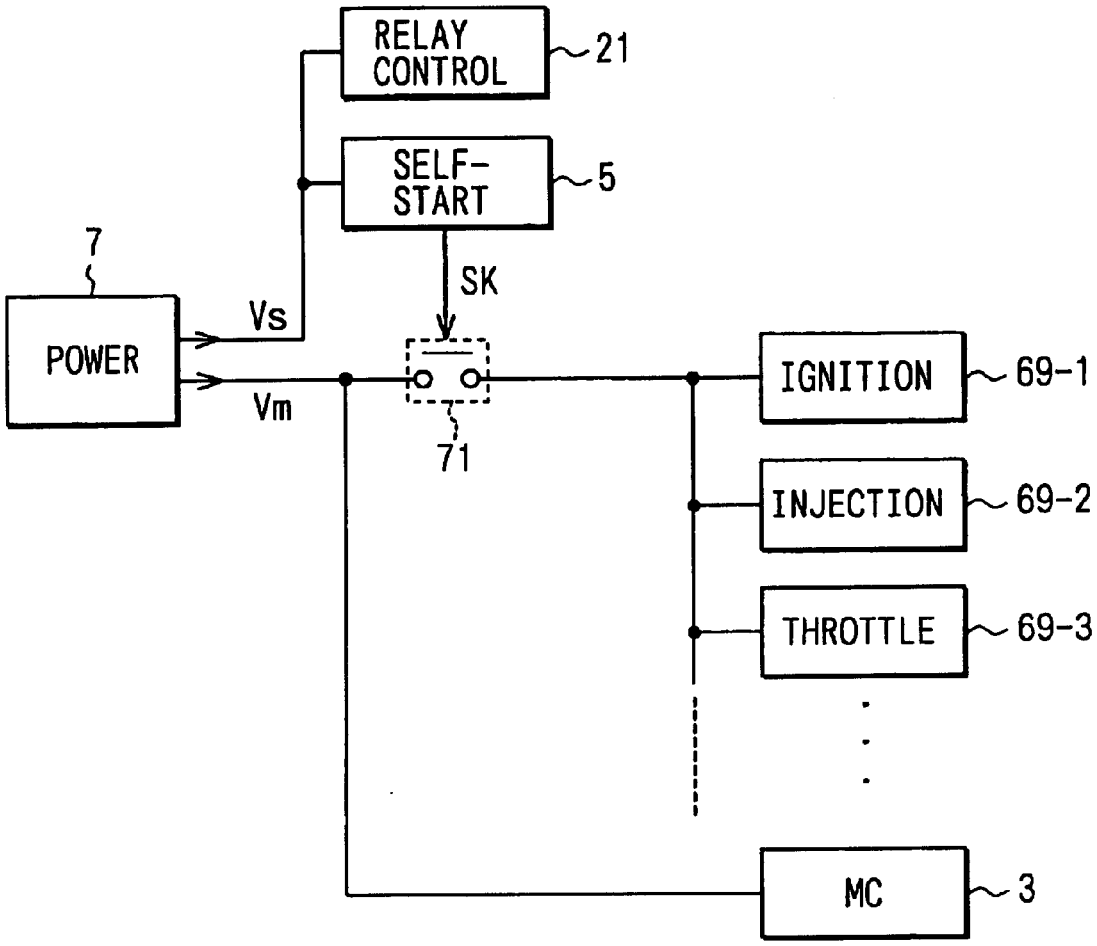
FIG. 5 is a block diagram showing an engine control unit according to a third embodiment of the present invention.

FIG. 5 shows an engine control unit according to a third embodiment. The same components in FIGS. 1 and 5 are assigned the same reference numerals and will not be described below in detail.

The microcomputer 3 of the engine control unit 1 according to the first embodiment functions as both the control circuit for the evaporation gas purging diagnosis process and the control circuit for other processes, which include a fuel injection control process and an ignition control process.

The engine control unit according to the third embodiment differs from the engine control unit 1 according to the first embodiment about the following points (a) and (b):

(a) The microcomputer 3 of this engine control unit functions as the exclusive control circuit for the evaporation gas purging diagnosis process. As shown in FIG. 5, the engine control unit includes control circuits 69-1, 69-2, 69-3, etc. independent of the microcomputer 3. These control circuits execute the control processes (for example, a fuel injection control process, an ignition control process or an electronic throttle control process) other than the evaporation gas purging diagnosis process.

(b) As shown in FIG. 5, the control circuits 69-1, 69-2, 69-3, etc. other than the microcomputer 3, which is the control circuit necessary for the evaporation gas purging diagnosis process, are supplied with the main supply voltage Vm from the power supply circuit 7 through a switching device 71, which may be a transistor or a relay. When the level of the power supply starting signal SK from the self-starting IC 5 is high, the switching device 71 is turned off so as to cut off the power supply (the supply of main supply voltage Vm) to the control circuits 69-1, 69-2, 69-3, etc.

The control circuits 69-1, 69-2, 69-3, etc. control the electric loads 25-1 to 25-n, which are needless for the evaporation gas purging diagnosis process. At step S170 in FIG. 3, instead of executing the engine control process, the microcomputer 3 determines from the information from the control circuits 69-1, 69-2, 69-3, etc. whether the ignition switch 11 is turned off, and whether the processes to be executed when the engine stops have ended. If the determination is positive (YES), the processing proceeds to step S160, where the level of the power supply holding signal SH to the main relay control circuit 21 is made low so that the main relay 13 is turned off.

If the engine control unit according to the third embodiment has been activated by the operation of its self-starting IC 5 while the engine is not operating, the power supply to the control circuits 69-1, 69-2, 69-3, etc., which are needless for the evaporation gas purging diagnosis process, is cut off so that these control circuits are inhibited from operating.

Accordingly, if the engine control unit according to this embodiment has been activated by the operation of its self-starting IC 5, the electric loads 25-1 to 25-n, which are needless for the evaporation gas purging diagnosis process, are inhibited from operating. This reliably prevents wasteful power consumption, thereby keeping the battery of the vehicle from being dead.

The switching device 71 thus performs inhibition. Part of the second embodiment (switching device 65 and drive circuit 67 in FIG. 4) might be applied to the engine control unit according to this embodiment. In this case, if the engine control unit has been activated by the operation of its self-starting IC 5, the power supply to the electric loads 25-1 to 25-n would be cut off. This would make the engine control unit more reliable.

(Fourth Embodiment)

Figure 6:
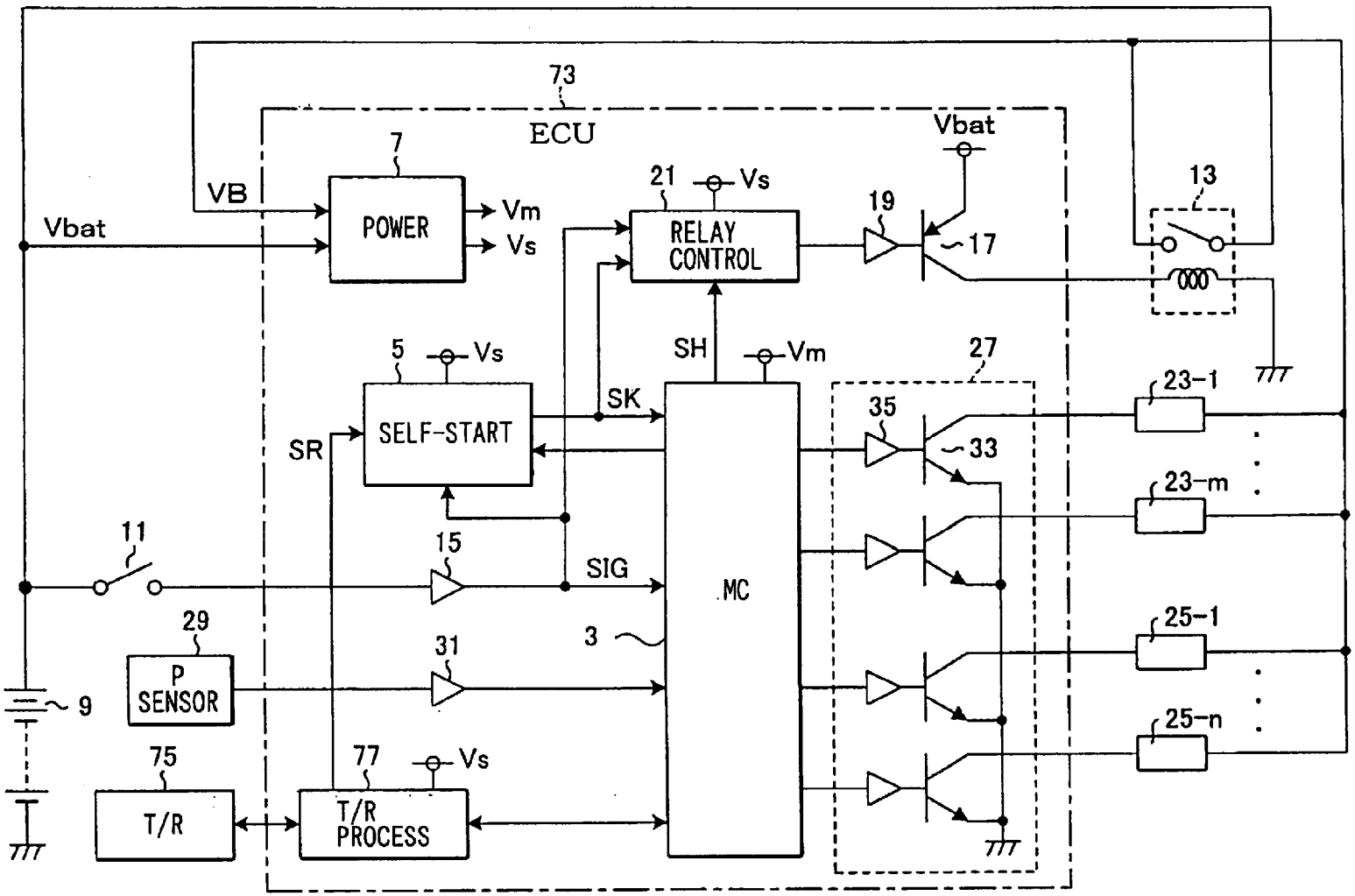
FIG. 6 is a block diagram showing an engine control unit according to a fourth embodiment of the present invention.

FIG. 6 shows an engine control unit 73 according to a fourth embodiment. The same components in FIGS. 1 and 6 are assigned the same reference numerals and will not be described below in detail.

As shown in FIG. 6, the engine control unit 73 differs from the engine control unit 1 according to the first embodiment about the following points (A)–(C):

(A) The engine control unit 73 can be used for a vehicle fitted with an on-vehicle transmitter/receiver (T/R) 75. The engine control unit 73 includes a transmit/receive processing circuit 77 for radio communication through the transmitter/receiver 75 with an external device, which is provided outside the vehicle.

The transmit/receive processing circuit 77 outputs a receipt detecting signal SR if it receives a diagnosis command, which is a signal commanding the execution of the evaporation gas purging diagnosis process, and which is one of the signals transmitted from the external device.

(B) If the transmit/receive processing circuit 77 outputs a receipt detecting signal SR when the level of the ignition switch signal SIG is low, the self-starting IC 5 holds the output level of the power supply starting signal SK high, in place of the foregoing function 1.

Figure 7:
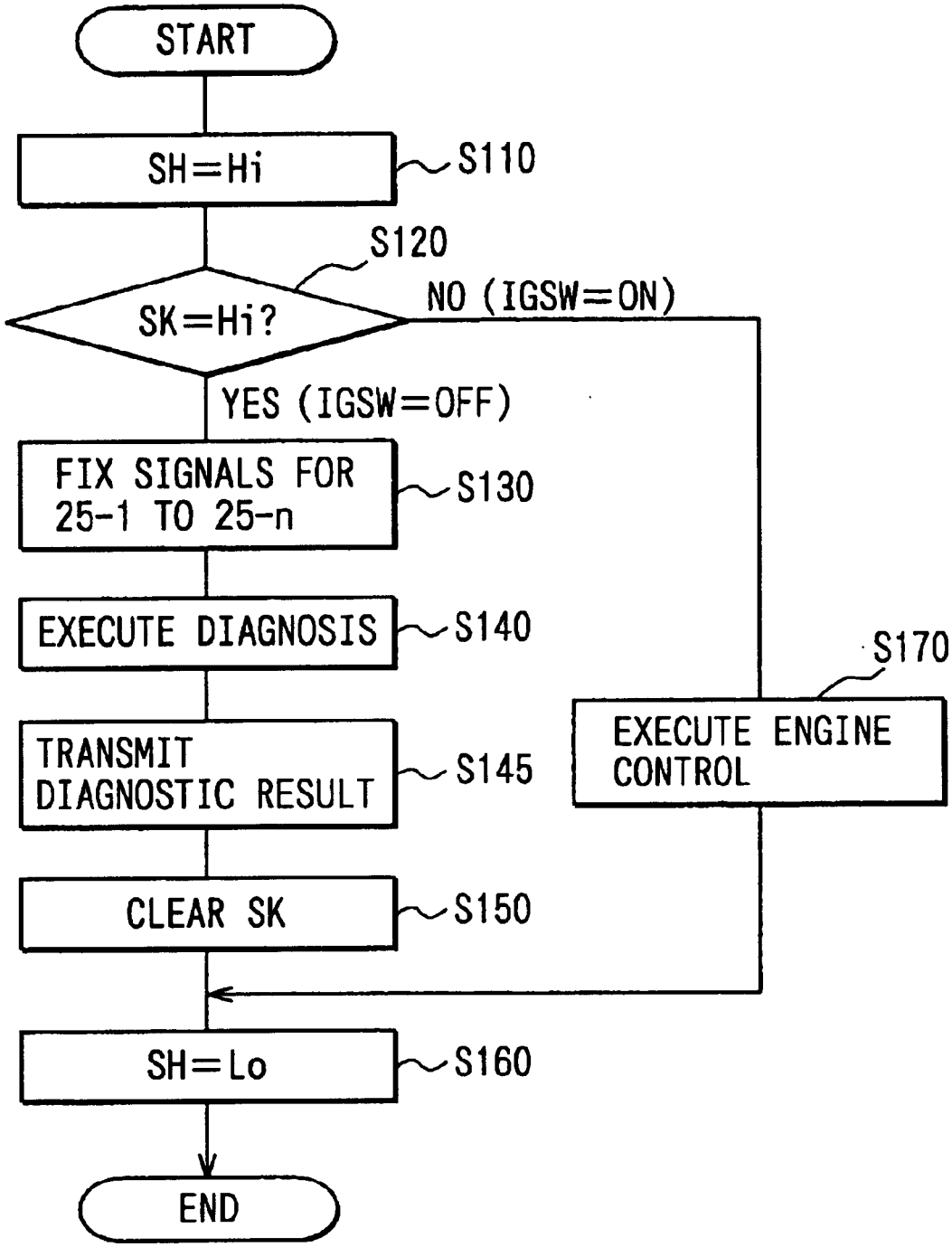
FIG. 7 is a flowchart showing the processing executed by a microcomputer of the engine control unit according to the fourth embodiment.

(C) The microcomputer 3 executes the processing shown in FIG. 7, in place of the processing shown in FIG. 3. The same steps in FIGS. 3 and 7 are assigned the same reference numerals and will not be described below in detail.

The processing shown in FIG. 7 includes step S145 between steps S140 and S150, which are shown in FIG. 3. After the microcomputer 3 finishes the evaporation gas purging diagnosis process at step S140, the processing proceeds to step S145. At step S145, the microcomputer 3 outputs the diagnostic result of the finished evaporation gas purging diagnosis process to the transmit/receive processing circuit 77. At step S145, the microcomputer 3 then makes the transmit/receive processing circuit 77 transmit the diagnostic result through the transmitter/receiver 75 to the external device. Thereafter, the processing proceeds to step S150.

If the transmit/receive processing circuit 77 receives the diagnosis command from the external device through the on-vehicle transmitter/receiver 75 while the engine of the vehicle is not in operation, with its ignition switch 11 turned off, the self-starting IC 5 and the main relay control circuit 21 operate to turn on the main relay 13, activating the engine control unit 73. The activated control unit 73 executes the evaporation gas purging diagnosis process and transmits the diagnostic result of this process to the external device.

Accordingly, it is possible to execute the evaporation gas purging diagnosis process and take out the diagnostic result to the external device at the arbitrary time when the external device transmits the diagnosis command. This makes it possible to monitor the condition of the evaporation gas purge system of the vehicle by means of remote operation from the external device.

In particular, if the engine control unit 73 has started up in accordance with the diagnosis command from the external device, the process at step S130 in FIG. 7 inhibits the operation of the electric loads 25-1 to 25-n, which are other than the electric loads 23-1 to 23-m necessary for the evaporation gas purging diagnosis process, as is the case with the engine control unit 1 according to the first embodiment. This prevents the battery of the vehicle from running down.

Part of the second embodiment (switching device 65 and drive circuit 67 in FIG. 4) might be applied to the engine control unit 73 according to this embodiment. In this case, if the engine control unit 73 has been activated by the operation of its transmit/receive processing circuit 77 and self-starting IC 5, the power supply to the electric loads 25-1 to 25-n would be cut off.

The microcomputer 3 of the engine control unit 73 according to this embodiment might, as shown in FIG. 5, function as the exclusive control circuit for the evaporation gas purging diagnosis process. The engine control unit 73 might, as also shown in FIG. 5, include control circuits 69-1, 69-2, 69-3, etc. for other control processes than the evaporation gas purging diagnosis process, independently of the microcomputer 3. In this case, as is the case with the third embodiment, when the level of the power supply starting signal SK from the self-starting IC 5 is high, the power supply (the supply of main supply voltage Vm) to the control circuits 69-1, 69-2, 69-3, etc. would be cut off.

The communication between the engine control unit 73 according to this embodiment and the external device may be cable communication. If the communication is radio communication, however, it is advantageous because there is no need to provide communication line between the engine control unit 73 and the external device.

When the engine control unit according to each of the embodiments executes the evaporation gas purging diagnosis process by starting up while the ignition switch 11 is maintained turned off, this unit may inhibit the operation of all the electric loads needless for this process. Some of the electric loads needless for the evaporation gas purging diagnosis process may be driven by the engine control unit when this unit normally starts up with the ignition switch 11 turned on. In terms of efficiency, the operation of only these particular loads may be inhibited.

Specifically, the engine control unit according to each of the embodiments drives the following electric loads (1)–(17):

(1) purge valve 53 shown in FIG. 2;
(2) electric pump 59 shown in FIG. 2;
(3) control valve 61 shown in FIG. 2;
(4) injectors for injecting fuel into the engine;
(5) an ignition devices (igniters and ignition coils) for igniting the mixture sucked into the engine;
(6) an electronic throttle motor for controlling the opening of the throttle valve;
(7) a linear solenoid valve and a solenoid valve (ECT linear solenoid valve and the ECT solenoid valve, respectively) for controlling a power transmission system, which includes a transmission;
(8) an oil control valve for smoothing the gear change in the transmission;
(9) a lock-up clutch solenoid for smoothing the engagement of a lock-up clutch of the transmission;
(10) a heater for activating an oxygen sensor fitted in the exhaust path of the engine;
(11) a heater for activating an A/F (air/fuel ratio) sensor fitted in the exhaust path;
(12) an exhaust lamp for warning a driver that the exhaust temperature is abnormally high;
(13) a warning lamp for warning a driver of the condition of the vehicle (other than the exhaust lamp);
(14) an overdrive (OD) lamp for warning a driver that the overdrive is cut;
(15) a fuel pump for supplying fuel from the fuel tank to the injectors;
(16) a cruise control lamp for warning a driver that cruise setting is made;
(17) a magnet clutch relay for the on-off control of a compressor of the air conditioner for the interior of the vehicle.

The electric loads (1)–(6) have been mentioned in the description of the embodiments. The electric loads (1)–(3) are necessary for the evaporation gas purging diagnosis process. The electric loads (4)–(17) are needless for this process.

When the engine control unit according to each of the embodiments executes the evaporation gas purging diagnosis process by starting up while the ignition switch 11 is maintained turned off, this unit may inhibit the operation of the electric loads (6)–(11), (13) and (17), which are needless for this process, by the method described for the embodiment. Namely, the engine control unit does not particularly need to inhibit the operation of the electric loads (4), (5), (12) and (14)–(16), which are needless for the evaporation gas purging diagnosis process, for the following reasons.

The injectors (4), ignition devices (5) and fuel pump (15) are activated only when a starter switch (not shown) is turned on or when the engine speed is detected.

The exhaust lamp (12) is activated (lit) only when the exhaust temperature is abnormally high.

Likewise, the overdrive lamp (14) is activated (lit) only when the overdrive is cut. Likewise, the cruise control lamp (16) is activated (lit) only when cruise setting is made.

Thus, the electric loads (4), (5), (12) and (14)–(16) are not driven (activated) by mere start-up of the engine control unit under normal conditions. Accordingly, when the engine control unit executes the evaporation gas purging diagnosis process by starting up while the ignition switch 11 is off, this unit does not particularly need to positively inhibit the operation of these electric loads.

By contrast, the electric loads (6)–(11), (13) and (17) may be driven by the engine control unit when this unit starts up normally with the ignition switch 11 turned on. The specific operation of each of these electric loads will be described below.

When the engine control unit starts up normally with the ignition switch 11 turned on, the electronic throttle motor (6) is driven to open the throttle valve up to a predetermined opening so as to suck sufficient air when the engine starts up.

When the engine control unit starts up normally with the ignition switch 11 turned on, the ECT linear solenoid valve and ECT solenoid valve (7), the oil control valve (8), and the lock-up clutch solenoid (9) are driven to fix the speed gear of the automatic transmission at the first.

When the engine control unit starts up normally with the ignition switch 11 turned on, the heater (10) and the A/F heater (11) are driven to heat the oxygen sensor and the A/F sensor so that these sensors can become active early.

When the engine control unit starts up normally with the ignition switch 11 turned on, the warning lamps (13) are driven (activated) for a predetermined time so that it is checked whether their bulbs have burned out or not.

If the operating switch for operating the air conditioner is turned on when the engine control unit starts up normally with the ignition switch 11 turned on, the magnet clutch relay (17) is driven according to the temperature of the engine cooling water.

As stated already, the engine control unit may drive the electric loads (6)–(11), (13) and (17) when it starts up normally with the ignition switch 11 turned on. Accordingly, when the engine control unit executes the evaporation gas purging diagnosis process by starting up while the ignition switch 11 is off, it is possible to reduce wasteful power consumption efficiently by positively inhibit the operation of only these electric loads (6)–(11), (31) and (17) of the electric loads (4)–(17) needless for the evaporation gas purging diagnosis process.

The electric loads (6)–(11), (13) and (17) maybe the electric loads 25-1 to 25-n shown in FIGS. 1, 4 and 6. In FIG. 5, the ignition control circuit 69-1 and injection control circuit 69-2, which control the ignition devices (5) and injectors (4), respectively, might be supplied with the main supply voltage Vm from the power supply circuit 7 directly without the switching means 71 interposed. Only the electronic throttle control circuit 96-3, which controls the electronic throttle motor (6), and the circuits for controlling the electric loads (7)–(11), (13) and (17) might be supplied with the main supply voltage Vm from the power supply circuit 7 through the switching means 71.

Thus, if the engine control unit starts up with the ignition switch 11 turned on, this unit drives the electric loads (6)–(11), (13) and (17) on the assumption that a driver and/or a passenger is present in the vehicle, that the engine has started up and/or that the vehicle is running. If the engine control unit starts up while the ignition switch 11 is off, this unit executes only the evaporation gas purging diagnosis process, which is the specific process having no relation to the presence of a driver and/or a passenger, the starting of the engine, and the running of the vehicle. In this case, it is not necessary at all to activate the electric loads (6)–(11), (13) and (17). The positive inhibition of the operation of these loads reduces wasteful power consumption, thereby preventing the battery from being dead.

In particular, the electronic throttle motor (6), the ECT linear solenoid valve and the ECT solenoid valve (7), the oil control valve (8), the lock-up clutch solenoid (9), the heater (10), and the A/F heater (11) are the electric loads that need to be driven before the engine or the transmission starts up. Because relatively great electric currents flow through the electric loads (6)–(11), it is possible to reduce wasteful power consumption effectively by positively inhibit the operation of these loads.

The preferred embodiments of the present invention have been described hereinbefore, which may be embodied in various forms.

Other control processes than the evaporation gas purging diagnosis process may be the specific control process executed with each of the engine control units activated if the associated ignition switch 11 is turned off.

Other starting conditions than that stated for the embodiments may be the condition on which the associated engine control unit starts up with the ignition switch 11 turned off.

What is claimed is:

1. An engine control unit for a vehicle including an ignition switch for an engine, a specific electric device and another electric device, the engine control unit comprising:

normal control means for performing an engine control with an operating power supplied in response to a turn-on of the ignition switch;

specific control means for performing a specific control other than the engine control with an operating power supplied in response to a specific power supply condition other than the turn-on of the ignition switch, the specific control using the specific electric device but not the another electric device; and inhibit means for inhibiting the another electric device from operating, when the specific control means operates in response to the specific power supply condition.

2. The engine control unit according to claim 1, wherein the specific electric device and the another electric device are a specific electric load and another electric load, respectively, and the inhibit means cuts off a supply of the operating power to the another electric load to inhibit the another electric load from operating.

3. The engine control according to claim 1, wherein the specific electric device and the another electric device are a specic electric circuit and another electric ciruit, respectively.

4. The engine control unit according to claim 3, wherein the inhibit means cuts off a supply of the operating power to the another circuit to inhibit the another circuit from operating.

5. An engine control unit for a vehicle including an ignition switch for an engine, a specific electric device and another electric device, the engine control unit comprising:

a microcomputer programmed to perform an engine control with an operating power supplied in response to a turn-on of the ignition switch and to perform a specific control other than the engine control with an operating power supplied in response to a specific power supply condition other than the turn-on of the ignition switch, the specific control using the specific electric device but not the another electric device, wherein the microcomputer is programmed to check whether a present supply of the operating power is in response to the specific power supply condition each time the operating power is supplied, and to inhibit the another electric device from operating when the present supply of the operating power is in response to the specific power supply condition, thereby performing the specific control.

6. The engine control unit according to claim 1, wherein the another electric device includes an electric load which becomes operable when the ignition switch is turned on.

7. The engine control unit according to claim 1, wherein the another electric device includes an electric load which is requied to be driven before the engine or a transmission of the vehicle starts operation.

8. The engine control unit according to claim 3, wherein the another electric circuit is for rendering operative an electric load which becomes operable when the ignition switch is turned on.

9. The engine control unit according to claim 8, wherein the another electric circuit is for controlling an electric load which is requied to be driven before the engine or a transmission of the vehicle starts operation.

10. The engine control unit according to claim 5, wherein the another electric device includes an electric load which becomes operable when the ignition switch is turned on.

11. The engine control unit according to claim 5, wherein the another electric device includes an electric load which is requied to be driven before the engine or a transmission of the vehicle starts operation.

12. The engine control unit according to claim 1, further comprising:

timer means for detecting that a predetermined time has passed after the normal control means stops operating with a turn-off of the ignition switch, wherein the specific power supply condition includes a detection of a lapse of the predetermined time by the timer means.

13. The engine control unit according to claim 1, further comprising:

communication means for communicating with an external device, wherein the specific power supply condition includes a reception of a signal from the external device by the communication means.

14. The engine control unit according to claim 13, wherein the specific control includes a process of diagnosing a specific part of the vehicle, and the communication means transmits a diagnostic result of the normal control means to the external device.

15. The engine control unit according to claim 13, wherein the communication means is for performing radio communication with the external device.

16. The engine control unit according to claim 1, wherein the the specific control includes a process of diagnosing an evaporation gas purge system of the vehicle.

* * * * *